United States Patent [19]

Monte

[11] 4,262,749

[45] Apr. 21, 1981

[54] FIRE SUPPRESSION BLADDER SYSTEM FOR FUEL TANKS

[75] Inventor: Anthony J. Monte, Utica, Mich.

[73] Assignee: The United States of America as represented by the Secretary of the Army, Washington, D.C.

[21] Appl. No.: 50,403

[22] Filed: Jun. 20, 1979

[51] Int. Cl.[3] ..... A62C 35/12

[52] U.S. Cl. ..... 169/62; 220/88 R

[58] Field of Search ..... 169/62, 66, 26, 11, 169/24; 220/88 R, 88 B

[56] References Cited

U.S. PATENT DOCUMENTS

| | | | |
|---|---|---|---|
| 3,387,662 | 6/1968 | Molgano, Jr. | 169/62 |
| 3,738,428 | 6/1973 | Ingro | 169/62 |
| 3,827,455 | 8/1974 | Lee | 220/88 R |
| 3,930,541 | 1/1976 | Bowman et al. | 169/62 |
| 4,132,271 | 1/1979 | Mikaila | 169/62 |

*Primary Examiner*—Robert J. Spar
*Assistant Examiner*—Kenneth Noland
*Attorney, Agent, or Firm*—Peter A. Taucher; John E. McRae; Nathan Edelberg

[57] ABSTRACT

Military vehicles equipped with upright fuel tanks are subject to near-explosion type fires when enemy projectiles pass through the tank. It is herein proposed to provide a source of pressurized fire suppressant near the fuel tank. Discharge of suppressant toward the emergent fireball is controlled by a squib valve that is triggered to the open condition by a pressure-responsive sensor mounted on the tank; the sensor responds to the shock wave generated by passage of the enemy projectile through the tank. Suppressant is directed toward the fireball by a bladder stretched across the inboard wall of the tank. Such a bladder advantageously has no metallic components that could fragment into dangerous lethal particles.

2 Claims, 5 Drawing Figures

FIRE SUPPRESSION BLADDER SYSTEM FOR FUEL TANKS

The invention described herein may be manufactured, used, and licensed by or for the Government for governmental purposes without payment to me of any royalty thereon.

BACKGROUND AND SUMMARY OF THE INVENTION

U.S. Pat. No. 3,930,541 issued to Bowman et al and U.S. Pat. No. 4,121,666 issued to E. J. Rozniecki disclose fire suppressant panels disposed on the inboard faces of fuel tanks in military vehicles to prevent fires that would otherwise be generated by passage of enemy projectiles through the tanks. One disadvantage of these fire-suppressant panels is that with the present state of the art knowledge these panels must be constructed of metals; as the projectile passes through the panel the shock forces produce fragmentation of the panel material. The flying fragments pose a danger to military personnel seated within the vehicle.

The present invention is directed to a substitute system for the metallic panels shown in the aforementioned patents. The substitute system contemplates a non-metallic bladder stretched across the inboard face of the fuel tank to direct pressurized suppressant from a conventional bottle into the potential fireball zone. Use of a bladder avoids the fragmentation problem present with the patented systems. The bladder is considered an alternative to the anti-fragmentation screen proposed in U.S. Pat. No. 4,132,271 issued to J. J. Mikaila.

THE DRAWINGS

Figure 1:
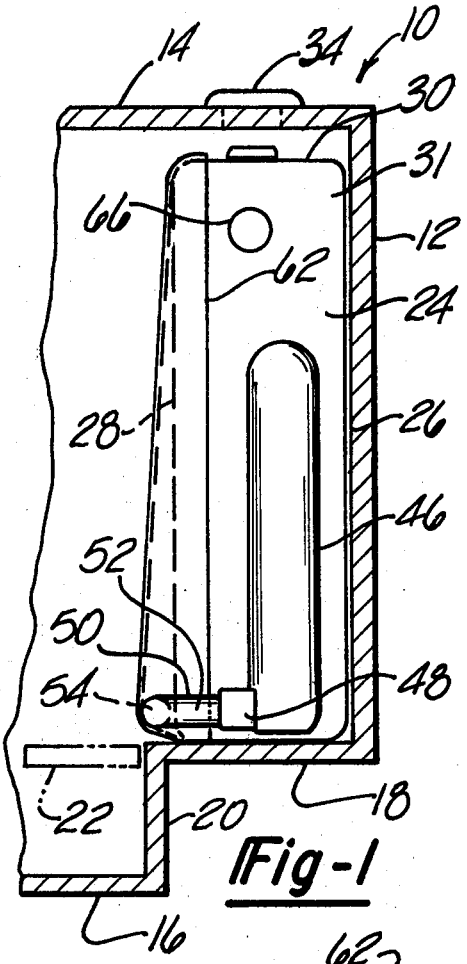
FIG. 1 is an end elevational view of a fuel tank positioned within a military vehicle and having a fire suppression system of the present invention associated therewith.
Figure 2:
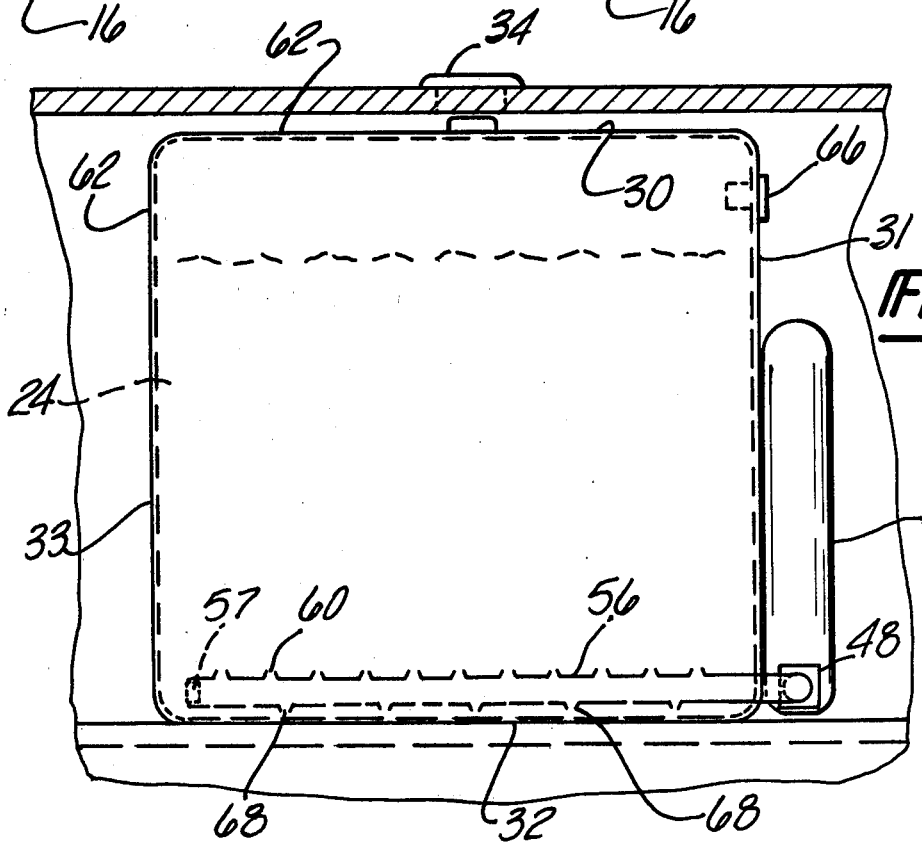
FIG. 2 is a front elevational view of the FIG. 1 mechanisms, looking from left to right in FIG. 1.

Referring especially to FIGS. 1 and 2, there is shown a fragmentary portion of a military vehicle 10 that includes a side wall 12, roof 14 and floor 16. The side wall is joined to the floor via a shelf 18 and vertical wall 20; the external space beneath shelf 18 accommodates conventional ground-engaged tracks, not shown. The contemplated vehicle is a personnel carrier designated by the U.S. Army as the M113 vehicle. It is large enough to carry approximately ten military personnel seated on benches extending longitudinally, i.e. parallel to side wall 12; one of the benches is shown by dashed lines 22 in FIG. 1.

Gasoline or diesel fuel for the M113 vehicle is carried in a generally rectangular fuel tank 24 positioned on or above shelf 18 near the rear end of the vehicle. The tank includes an outboard major side wall 26, an inboard major side wall 28, and four peripheral walls 30 through 33. This tank would have a height of about 2½ feet, a width of about 1 foot and a length of about 4 feet. Initial fill-up of the tank is through an opening in roof 14, normally closed by a hinged cover 34.

Figure 3:
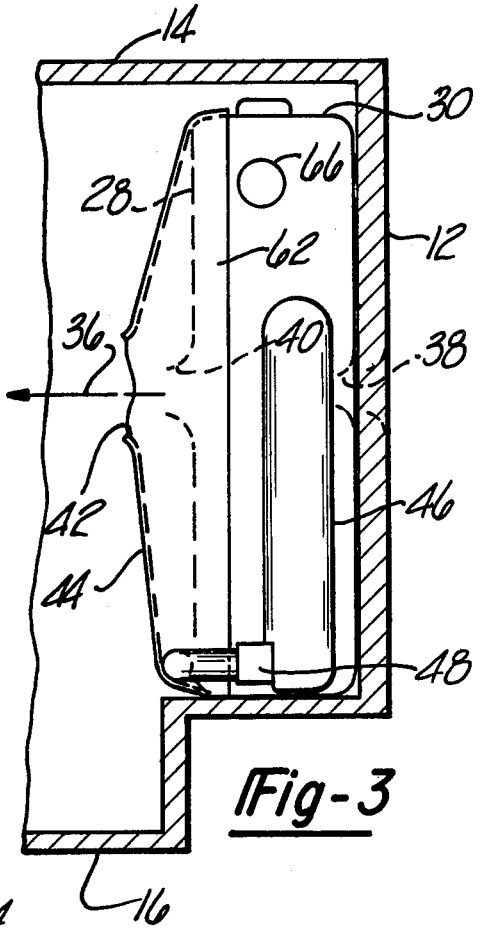
FIG. 3 is a view similar to FIG. 1, but showing the system condition during passage of an enemy projectile through the fuel tank and bladder.

The illustrated vehicle is equipped with a mechansim designed to prevent fires that might otherwise be generated by the passage of enemy projectiles through the fuel tank; the testing baseline threat is the so-called HEAT round (high explosive antitank), which is an armor piercing shaped charged warhead having a diameter of 3.5 inches. FIG. 3 illustrates the condition of the fuel tank after passage therethrough of a projectile along a pathline designated by numeral 36. The projectile forms a relatively small entry hole 38 in the tank outboard wall 24 and a somewhat larger exit hole 40 in the tank inboard wall 28. The projectile and metal fragments from the tank wall also form a hole 42 in a non-metalic bladder 44 that is part of my fire suppression mechanism.

The fire suppression mechanism includes a thick-walled metallic bottle or pressure vessel 46 suitably mounted in a fixed location in close proximity to fuel tank 24. The preferred location is alongside tank wall 31 in an unused area away from the personnel space. Bottle 46 is charged with a fire-suppressant, preferably bromotrifluoromethane sometimes identified by the term "Halon 1301". The bottled fire suppressant is charged to a relatively high pressure, e.g. 750 p.s.i., as described generally in U.S. Pat. No. 3,915,237. At its lower end the bottle is provided with a fast-acting squib-operated valve 48 which may be constructed similarly to valve 38 in above-mentioned U.S. Pat. No. 3,915,237. A solenoid valve may be used instead of the squib-operated valve.

A discharge pipe 50 extends from valve 48 through a small hole in bladder 44. The discharge pipe includes a short pipe section 52 connected to valve 48, a curved right angle section 54, and a relatively long pipe section 56 extending along the inboard wall 28 of fuel tank 24 near its lower edge. As best seen in FIG. 2, pipe section 56 is provided with a number of port openings or small nozzles 60 in its upper surface; the left end of pipe section 56 is closed by a plug 57. When valve 48 is actuated to the open condition pressurized suppressant is directed through pipe 50 and out of port openings 60 into the confined space between bladder 44 and tank wall 28. The direction of discharge is preferably upward parallel to wall 28. As the discharged suppressant fills the confined space between wall 28 and bladder 44 it tends to balloon the bladder outwardly to the condition shown in FIG. 3. Suppressant escapes from the confined space through hole 42 that is formed by the projectile.

Bladder 44 has a dimension that corresponds to the heighth and width of tank wall 28. Additionally the bladder preferably includes an inturned peripheral edge or flange 62 used to mount the bladder on the fuel tank or adjacent structure. Flange 62 may be joined to the tank surface by any convenient means, as for example adhesives or pin-eyelet devices. The embodiment of FIGS. 1 through 3 contemplates adhesive type connections. The embodiment of FIG. 4 includes a series of pins 64 projecting from the surface of tank 24 through metal eyelets carried by peripheral edge areas of the bladder. The joint between the fuel tank and the edges of bladder 44 need not be air-tight. However it should be a relatively close fit or connection, whereby pressurized suppressant from port openings 60 (FIG. 2) will be directed through the hole 42 in the bladder, rather than through spaces at the periphery of the bladder.

Figure 5:
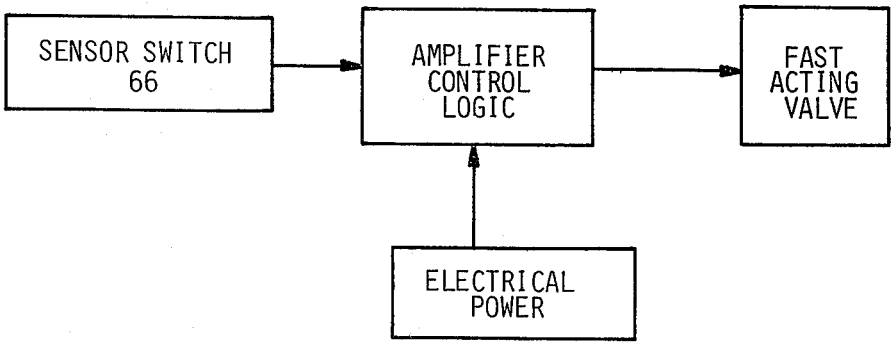
FIG. 5 is a diagrammatic illustration of circuitry for triggering a fire suppressant control valve under the invention.

Fire suppressant flow through valve 48 is preferably triggered by a conventional state-of-the-art pressure switch or sensor 66 of the fast acting type mounted on one wall of fuel tank 24. The use of such a switch or sensor is herein proposed for the reason that a shock wave is generated within the fuel tank when a projectile warhead is passing through the tank. Measurements using piezoelectric and bridge-type pressure transducers indicate that a short duration pressure wave of approximately 600 p.s.i. is generated within the tank interior during the passage of the projectile. A conventional switch or sensor 66 set for actuation at some lower pressure, e.g. 200 p.s.i., may be used as a triggering device for the squib valve 48 (or alternate solenoid valve). The pressure switch or sensor is preferably mounted to overlie an opening in the tank wall, whereby the switch diaphragm or other pressure-sensing device is exposed to tank internal pressure conditions. Device 66 can be a diaphragm-operated switch or strain gage or piezoelectric crystal unit that is responsive to pressure step increases within the interior of fuel tank 24. Device 66 may be electrically connected to valve 48 by an amplifier-control system of the type described in U.S. Pat. No. 4,110,812 issued to G. Arutunian and A. J. Monte. Attached to FIG. 5 illustrates the general operation of the amplifier-control system.

Device 66 can also be a light-responsive device rather than a pressure-responsive device. Passage of a HEAT round through a fuel tank generates an intense momentary radiation in the ultra-violet range. A photo-electric sensor responsive to ultraviolet radiations can be mounted on the fuel tank in an attitude such that the sensor is targeted onto the interior space within the tank. Electrical output of the sensor can be applied to a control logic for triggering the fire suppressant discharge valve.

It will be understood that with the system shown in attached FIGS. 1 through 3 the passage of the enemy projectile through the fuel tank produces an immediate actuation of switch or sensor 66 and resultant opening of valve 48. Very shortly after the projectile has formed the opening 42 in bladder 44 the fire suppressant is discharged upwardly through ports 60 to fill the limited space between wall 28 and the bladder. The wake area behind the projectile entrains liquid fuel from the tank; simultaneously the Halon 1301 fire suppressant is directed toward hole 42 to mix with the fuel and prevent ignition (or extinguish an already-present ignition condition). Some fire suppressant may flow through hole 40 into the fuel tank after the initial shock wave has subsided.

The liquid fuel entrained in the wake area of the projectile will eventually deposit on floor 16 to the left of bladder 44. To prevent subsequent ignition of fuel at or near the floor area it may be desirable to spray a minor amount of fire suppressant downwardly from discharge pipe section 56. As shown in FIG. 2, a number of small ports 68 are formed in the undersurface of pipe section 56 for discharge of suppressant in a direction downward and to the left of bladder 44. Bladder 44 may have small openings registering with ports 68 to permit unobstructed flow of suppressant.

Figure 4:
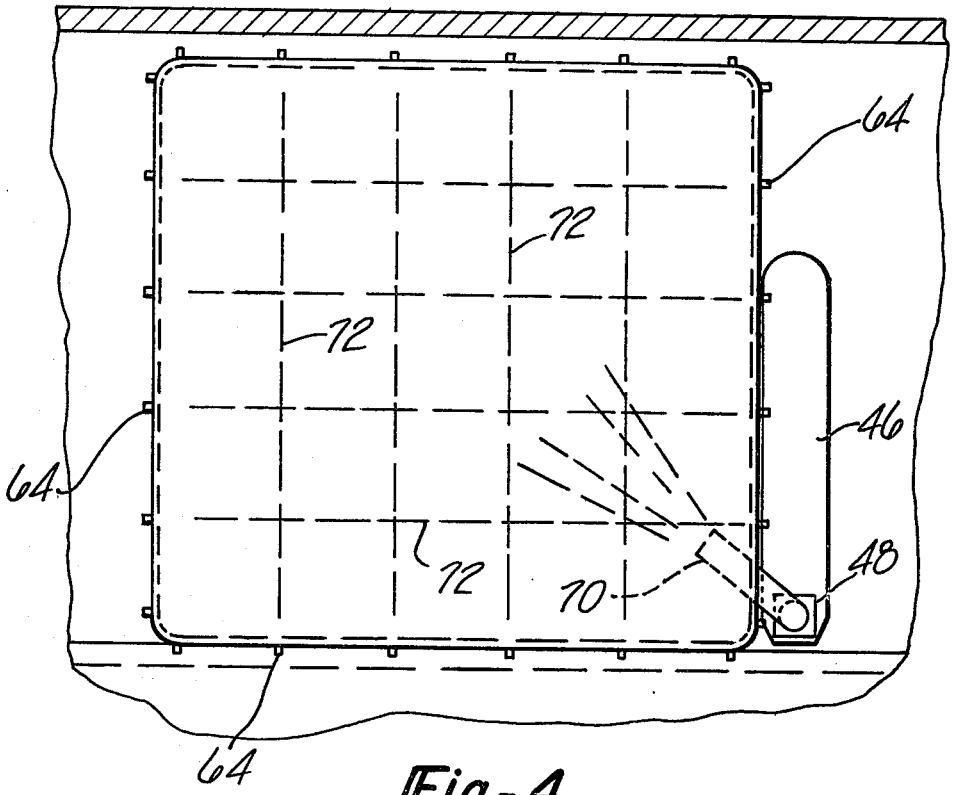
FIG. 4 is a view similar to FIG. 2, but showing a second embodiment of the invention.

The system of FIG. 2 includes a relatively long discharge pipe section 56, approximately four feet in a representative situation. FIG. 4 illustrates an alternate system that is generally similar to the FIG. 2 system except that pipe section 56 is replaced by a short pipe 70 arranged to discharge fire suppressant upwardly and leftwardly toward the central area of the confined space between the bladder and inboard wall of the fuel tank. The use of short pipe section 70 may be advantageous in somewhat reducing the suppressant travel time from the bottle to the rupture hole 42 in the bladder. Actual travel time is to a certain extent dependent on the location of the projectile-produced hole, near or remote from pipe section 70.

The bladder is preferably formed of a non-metallic fire-resistant material having flexibility, but little or no resiliency. One suitable material appears to be a high strength fabric marketed by the Dupont Co. under the tradename "Nomex". Another suitable fire-resistant material is "Kynol" marketed by the Carborundum Co. The selected materials are in the nature of upholstery fabrics commonly used for automobile seats and interiors. The materials are resistant to tearing so that when they are used for bladders in fire-suppressant systems the action of the projectile will produce a localized hole or rupture, as opposed to an extensive or massive split of the entire fabric. If the fabrics in the as-received state do not possess satisfactory tear resistance, it may be necessary to reinforce the material at selected points in order to break or interrupt tear forces generated by the projectile forces. One possible way in which to locally reinforce the material is to machine sew heavy cord into the material in a criss-cross pattern. A representative pattern is designated by numeral 72 in FIG. 4.

I wish it to be understood that I do not desire to be limited to the exact details of construction shown and described for obvious modifications will occur to a person skilled in the art.

I claim:

1. In a military vehicle having an upright fuel tank disposed therewithin in close proximity to one of the vehicle sidewalls; said fuel tank having two major walls located generally parallel to the vehicle sidewall, the improvement comprising a bladder (44) made of non-metallic imperforate flexible fabric material capable of resisting tears, said fabric bladder having length-width dimensions that correspond to the length and width of said fuel tank, with said bladder being anchored at its periphery to the fuel tank in close adjacency to the inboard face thereof whereby enemy projectiles fired through the vehicle sidewall will pass through the fuel tank and bladder, a fire suppressant system to eliminate fireballs that may be generated by the passage of a projectile through the fuel tank, said fire suppressant system comprising a thick-walled metallic pressure vessel (46) suitably mounted in a fixed location in close proximity to the fuel tank (24), said metallic vessel (46) being charged with a pressurized fire suppressant, said vessel (46) being equipped with a normally closed, fast-acting, electrically-operated discharge valve (48), a discharge pipe (50) extending from said valve (48) into the confined space between the bladder (44) and the adjacent fuel tank wall, said pipe (50) comprising a relatively short pipe section (52) which is connected to valve (48), a curved right angle pipe section (54) which negotiates the turn from the side (31) of the fuel tank to the face thereof which is adjacent to the personnel carrying compartment and a long pipe section (56) of substantially the same length as the length of the fuel tank (46), said long pipe section extending along the inboard wall (28) of fuel tank (24) near its lower edge, said long pipe section (56) having a number of relatively small nozzle openings positioned so that selected openings face up or down along the pipe length for directional discharge of pressurized suppressant, respectively into the space between the bladder and fuel tank inboard face or the vehicle floor, the end (57) of the long pipe section (56) furthest from valve (48) being closed, and a switch means having a sensor operator responsive to step changes in physical condition of the atmosphere within the tank due to passage of an enemy projectile therethrough, said switch means being operatively connected to the valve for actuating said valve to the open condition when the above-mentioned step change takes place.

2. The improvement of claim 1 wherein the sensor operation of the switch means is responsive to pressure changes in the tank atmosphere.

* * * * *